US006038246A

United States Patent [19]

Shimizu et al.

[11] Patent Number: 6,038,246

[45] Date of Patent: Mar. 14, 2000

[54] METHOD AND APPARATUS FOR OPERATING A FURNACE

[75] Inventors: Hiroshi Shimizu, Wexford; Joseph L. Hake, New Castle; Richard L. Cook, Pittsburgh, all of Pa.

[73] Assignee: NKK Steel Engineering, Inc., Mars, Pa.

[21] Appl. No.: 08/806,204

[22] Filed: Feb. 26, 1997

[51] Int. Cl.[7] ..... F27D 23/00

[52] U.S. Cl. ..... 373/78; 373/84

[58] Field of Search ..... 373/72, 78, 79, 373/83, 84; 393/80, 108

[56] References Cited

U.S. PATENT DOCUMENTS

| | | | |
|---|---|---|---|
| 3,382,912 | 5/1968 | Philbrick, Jr. | 164/254 |
| 3,905,589 | 9/1975 | Schempp et al. | 266/222 |
| 3,984,613 | 10/1976 | Reese | 373/84 |
| 4,336,411 | 6/1982 | Hanas et al. | 373/85 |
| 4,466,104 | 8/1984 | Walzel | 373/78 |
| 4,715,041 | 12/1987 | Biihler et al. | 373/72 |

*Primary Examiner*—Mark Paschall
*Assistant Examiner*—Quang Van
*Attorney, Agent, or Firm*—Ansel M. Schwartz

[57] ABSTRACT

A direct current electric arc furnace for melting or heating raw material or molten material. The furnace includes a refractory lined vessel for holding raw or molten material. The vessel has at least an old furnace shell having a bottom electrode which is replaceable with a new furnace shell having a bottom electrode such that the new furnace shell is placed in an operating position and replaces the old furnace shell. The furnace includes at least a first top electrode. The furnace includes at least a first bottom electrode mounted in the bottom of the vessel and in electrical contact with the raw or molten material in the vessel. The furnace includes an electrical power supply mechanism which electrically connects to the top electrode and the bottom electrode in order to input electrical energy into the materials through the top and bottom electrode and the form of an arc. The bottom electrode has opposite electrical polarity to the electrical polarity of the top electrode. The furnace also includes a repair area to receive the old furnace shell. The repair area has a mechanism for separating the bottom electrode of the old furnace shell from the old furnace shell. The repair area is remote from the vessel. The furnace includes a mechanism for moving the old furnace shell between the vessel and the repair area. A method for operating a direct current arc furnace.

12 Claims, 9 Drawing Sheets

METHOD AND APPARATUS FOR OPERATING A FURNACE

CROSS-REFERENCE

This application is related to contemporaneously filed U.S. patent application Ser. No. 08/806,848 titled "A Method and Apparatus for Heating Materials" by Hiroshi Shimizu, Joseph L. Hake, and Richard L. Cook, having attorney docket number NKK-1, incorporated by reference herein, and U.S. patent application Ser. No. 08/807,803 titled "A Direct Current Arc Furnace and a Method for Operating the Arc Furnace" by Hiroshi Shimizu, Joseph L. Hake, and Richard L. Cook, having attorney docket number NKK-3, incorporated by reference herein.

FIELD OF THE INVENTION

The present invention is related to a direct current arc furnace. More specifically, the present invention is related to a direct current arc furnace which has off-furnace bottom electrode exchange.

BACKGROUND OF THE INVENTION

Large DC arc furnaces equipped with one (1) or more bottom electrodes require a significant amount of furnace down time to maintain and/or repair the bottom electrode(s). Typically, this repair can take sixteen (16) to twenty-four (24) hours of furnace downtime every 1500 heats, which results in a considerable loss in furnace production.

The bottom electrode of a DC arc furnace must be replaced every 1000 to 2000 heats. Presently the normal bottom electrode exchange procedure occurs at the furnace. This bottom electrode procedure may take from 12 to 24 hours during which time production is lost. The on-furnace exchange procedure is outline below.

1) The furnace is drained of all metal and allowed to cool for several hours.
2) A digging machine is placed on the furnace upper shell. This digging machine has a pneumatic jack hammer which is articulated on an arm which can pivot 360 degrees. The digging device is used to loosen the refractory material in the slip joint between the bottom electrode refractory and the shell refractory. This digging process may take an additional hour or two.
3) The power connections along with air and/or water connections to the bottom electrode must be disconnected.
4) A portable bottom electrode push-up device is placed on the ladle car and driven underneath the furnace vessel. This push-up device consists of a cylindrical metal fabrication called the push-up head which aligns with the lower perimeter of the bottom electrode. This push-up head is raised up to the bottom electrode by a large bore hydraulic cylinder. This cylinder develops several hundred tons of force to break the bottom electrode free of the hearth refractory and lift it to an elevation where it can be secured with a sling and lifted out of the vessel by overhead crane.
5) Any refractory loosened or damaged when the bottom electrode was pushed out is repaired. Areas of worn refractory are built back up to the proper thickness.
6) A new or re-built bottom electrode is lowered into the vessel and aligned so that all of the power, air and/or water connections can be re-connected.
7) The slip joint between the shell refractory and the bottom electrode refractory is filled with a ramming mix and tamped down.

8) The bottom electrode push-up device is removed from underneath the furnace.
9) The furnace is re-started.

The present invention utilizes an off-furnace bottom electrode exchange. The basic idea of an off-furnace bottom electrode exchange is to minimize the amount of production time lost. This is accomplished by having a spare furnace shell with a new or re-built bottom electrode already in place. Also, other maintenance to the furnace shell such as tap hole exchanges and water cooled panel repair or replacement can be done off-line saving additional downtime. In addition to limiting down time the maintenance work can be stretched out over a longer period of time providing scheduling flexibility, time for higher quality work, and possibly reducing or eliminating maintenance overtime.

SUMMARY OF THE INVENTION

The present invention pertains to a direct current electric arc furnace for melting or heating raw material or molten material. The furnace comprises a refractory lined vessel for holding raw or molten material. The vessel has at least an old furnace shell having a bottom electrode which is replaceable with a new furnace shell having a bottom electrode such that the new furnace shell is placed in an operating position and replaces the old furnace shell. The furnace comprises at least a first top electrode. The top electrode enters the vessel above the raw or molten material. The furnace comprises at least a first bottom electrode mounted in the bottom of the vessel and in electrical contact with the raw or molten material in the vessel. The furnace comprises an electrical power supply mechanism which electrically connects to the top electrode and the bottom electrode in order to input electrical energy into the materials through the top and bottom electrode and the form of an arc. The bottom electrode has opposite electrical polarity to the electrical polarity of the top electrode. The furnace also comprises a repair area to receive the old furnace shell. The repair area has a mechanism for separating the bottom electrode of the old furnace shell from the old furnace shell. The repair area is remote from the vessel. The furnace comprises a mechanism for moving the old furnace shell between the vessel and the repair area.

The present invention pertains to a method for operating a direct current arc furnace. The method comprises the steps of operating the direct current arc furnace with an old vessel to melt metal. Next, there is the step of terminating the operation of the furnace. Then, there is the step of disconnecting the old vessel of the furnace from the furnace. Next, there is the step of removing the old vessel having a bottom electrode from the furnace. Next, there is the step of placing a new vessel having a bottom electrode with the furnace. Then, there is the step of connecting the new vessel with the furnace. Next, there is the step of operating the furnace with the new vessel to melt metal.

The present invention pertains to a method for operating a direct current arc furnace. The method comprises the steps of operating the direct current arc furnace with a vessel having an old bottom furnace shell to melt metal. Next, there is the step of terminating the operation of the vessel. Then, there is the step of separating a furnace cover of the vessel from the old furnace shell having a bottom electrode. Next, there is the step of disconnecting the old furnace shell from the furnace. Then, there is the step of removing the old furnace shell from the furnace. Next, there is the step of placing a new bottom furnace shell having a bottom electrode with the furnace. Then, there is the step of connecting the new furnace shell with the furnace. Next, there is the step of putting the furnace cover on the furnace shell. Then, there is the step of operating the furnace with the new furnace shell to melt metal.

The present invention provides a furnace design such that the furnace shell complete with the bottom electrode can be readily detached from the furnace platform, the water and electrical connections to the furnace shell and bottom electrode can be easily disconnected, and the total furnace shell with bottom electrode can be moved by means of an overhead crane to a repair area; and a spare furnace shell complete with bottom electrode can be moved from the repair area to the furnace and be installed at the furnace, and the water ready for operation in a minimum amount of time, thereby reducing significantly the lost production usually associated with bottom electrode repair. In order to accomplish this quick change, the furnace design includes quick disconnect features for all electrical and water cooling circuits to and from the furnace shell and the connection between the furnace shell and platform.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1A:
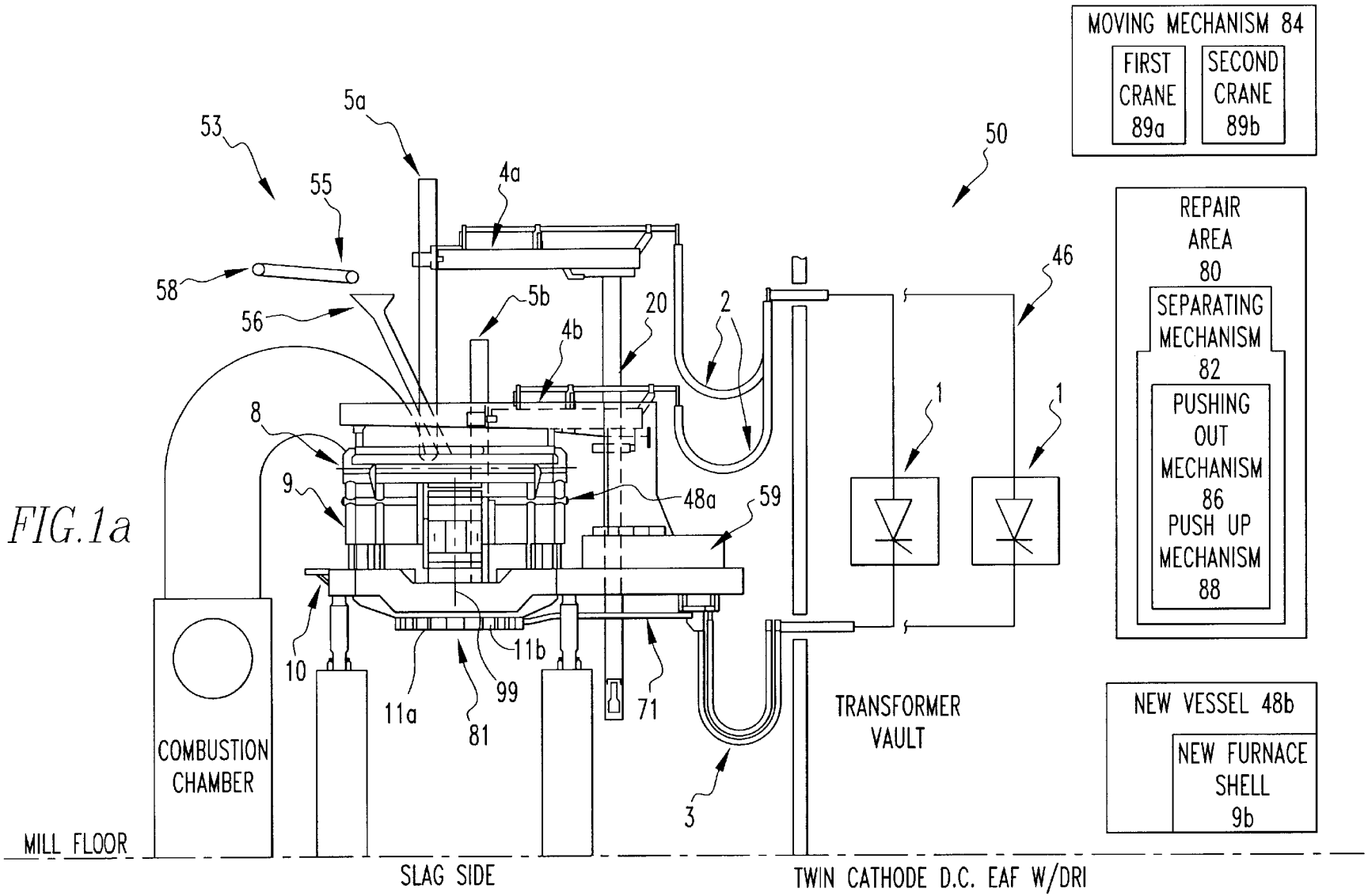
FIG. 1*a* is a schematic representation of a side view of the furnace of the present invention.

Referring now to the drawings wherein like reference numerals refer to similar or identical parts throughout the several views, and more specifically to FIG. 1*a* thereof, there is shown a direct current electric arc furnace 50 for melting or heating raw material 44 or molten material 44. The furnace 50 comprises a refractory lined vessel 48 for holding raw or molten material 44. The vessel 48 has at least an old bottom furnace shell 9*a* having a bottom electrode 11 which is replaceable with a new bottom furnace shell 9*b* having a bottom electrode 11 such that the new furnace shell 9*b* is placed in an operating position and replaces the old furnace shell 9*a*. The furnace 50 comprises at least a first top electrode 5. The top electrode 5 enters the vessel 48 above the raw or molten material 44. The bottom electrode 11 of the old furnace shell 9*a* is in electrical contact with the raw or molten material 44 in the vessel 48. The furnace 50 comprises an electrical power supply mechanism 46 which electrically connects to the top electrode 4 and the bottom electrode 11 in order to input electrical energy into the material 44 through the top and bottom electrode in the form of an arc 54. The bottom electrode 11 has opposite electrical polarity to the electrical polarity of the top electrode 4. The furnace 50 also comprises a repair area 80 to receive the old furnace shell 9*a*. The repair area 80 has a mechanism 82 for separating the bottom electrode 11 of the old furnace shell 9*a* from the old furnace shell 9*a*. The repair area 80 is remote from the vessel 48. The furnace 50 comprises a mechanism 84 for moving the old furnace shell 9*a* between the vessel 48 and the repair area 80.

Figure 2B:
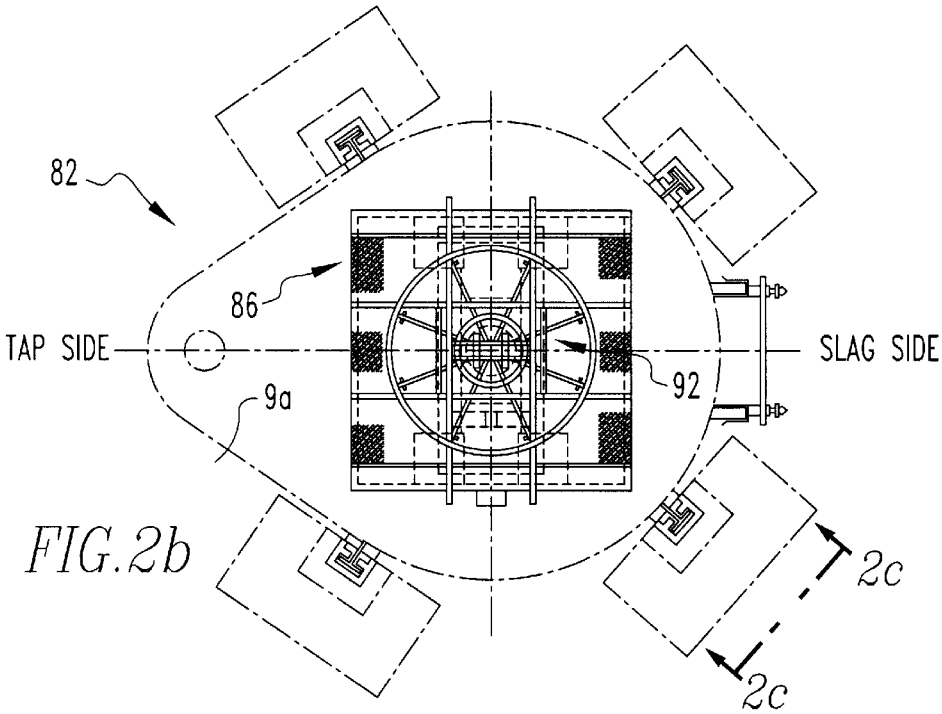
FIGS. 2*a*, 2*b* and 2*c* are schematic representations of a separating mechanism of the present invention.
Figure 2A:
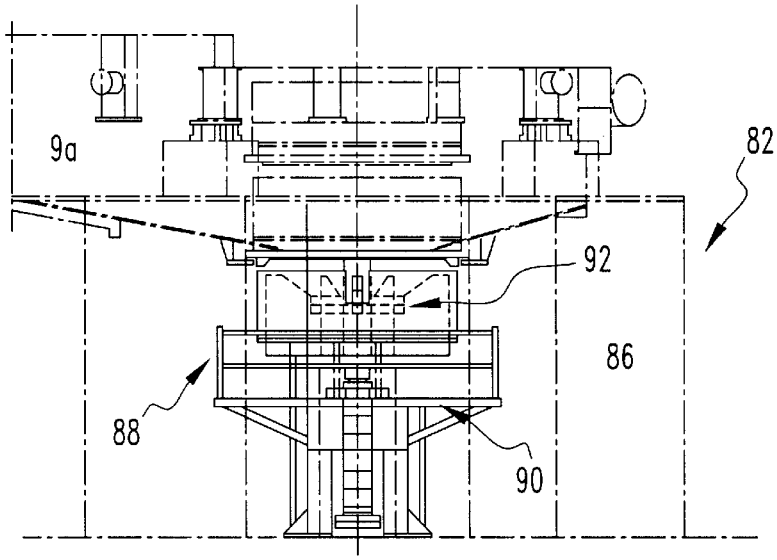
Figure 3:
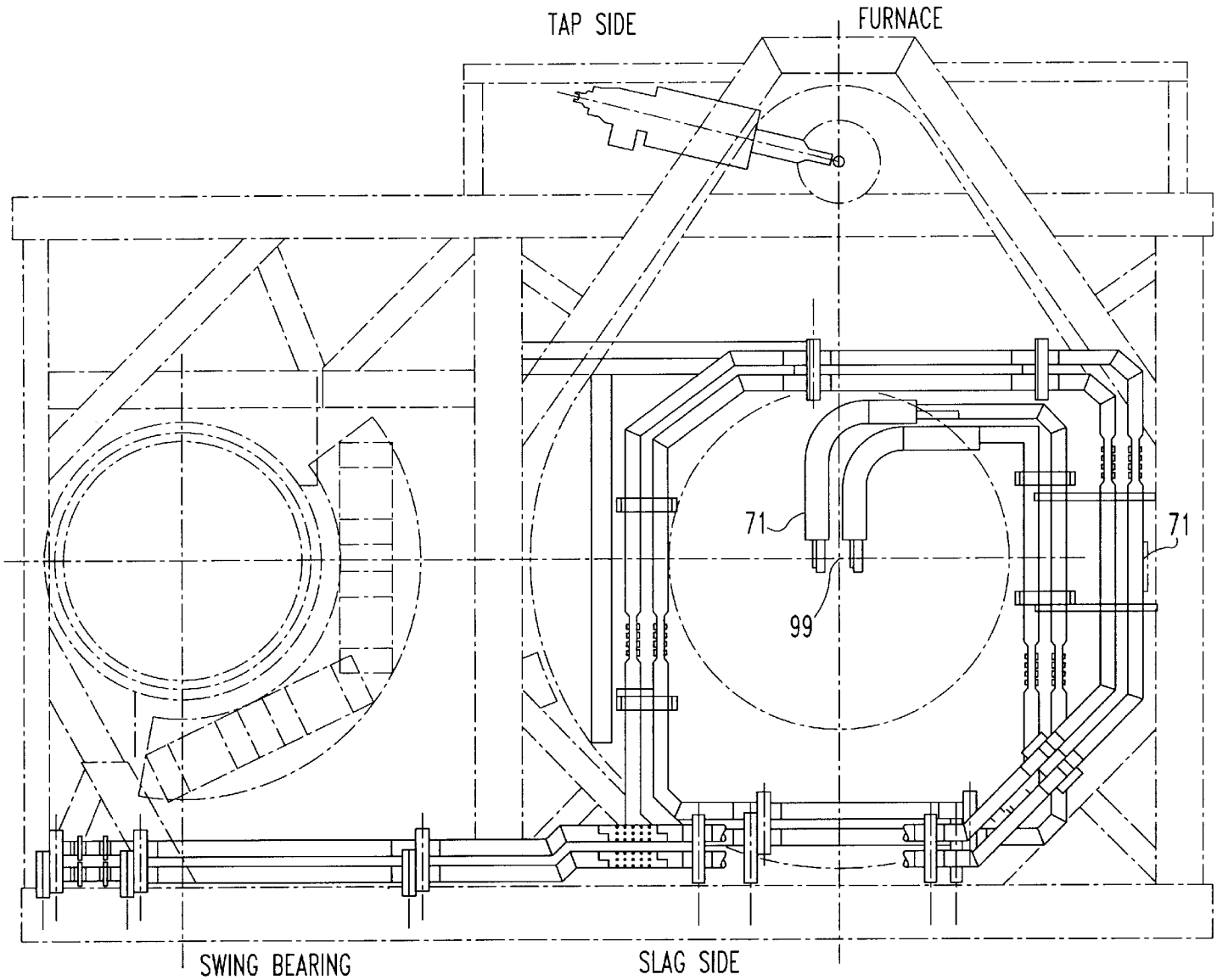
FIG. 3 is a schematic representation of an overhead view of the power cables of the furnace.
Figure 8:
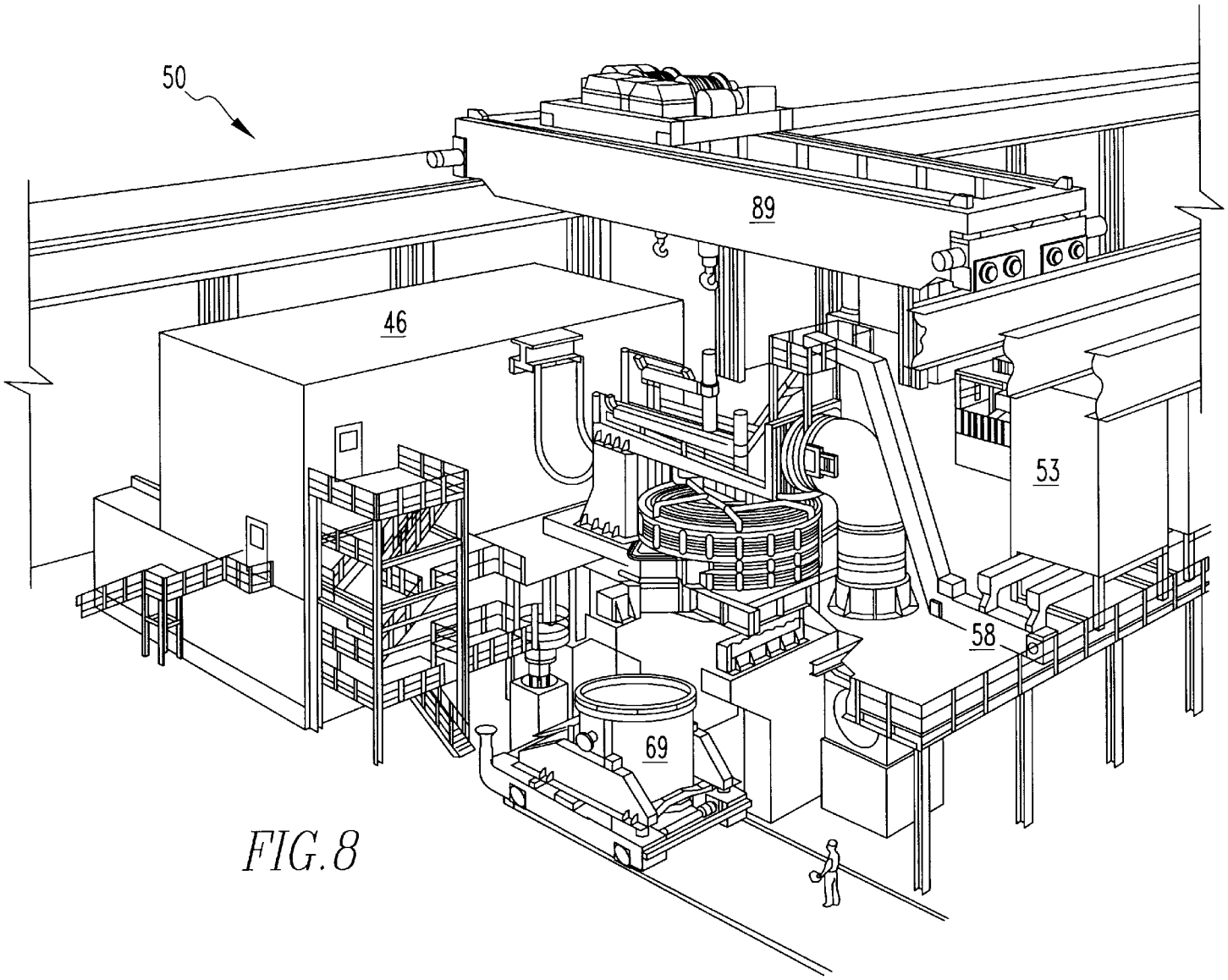
FIG. 8 is a schematic representation of a perspective view of the furnace.

Preferably, the separating mechanism 82 includes a mechanism 86 for pushing out the bottom electrode 11 of the old furnace shell 9*a* from the old furnace shell 9*a*. The pushing out mechanism 86 preferably includes a push-up device 88 having a push-up head 90 with a removable guide beam 92, as shown in FIGS. 2*a* and 2*b*, for aligning terminal blades 94, as shown in FIG. 8, of the bottom electrode 11 so they will be in proper position to connect to power cables 96, as shown in FIG. 3, on the furnace 50 when the bottom electrode 11 is returned to the furnace 50.

The present invention pertains to a method for operating a direct current arc furnace 50. The method comprises the steps of operating the direct current arc furnace 50 with an old vessel 48*a* to melt metal 44. Next there is the step of terminating the operation of the furnace 50. Then there is the step of disconnecting the old vessel 48*a* of the furnace 50 from the furnace 50. Next there is the step of removing the old vessel 48*a* having a bottom electrode 11 from the furnace 50. Next there is the step of placing a new vessel 48*b* having a bottom electrode 11 with the furnace 50. Then there is the step of connecting the new vessel 48*b* with the furnace 50. Next there is the step of operating the furnace 50 with the new vessel 48*b* to melt metal 44.

The vessel 48 can be comprised of a furnace shell 9 and a furnace cover 8. The present invention pertains to a method for operating a direct current arc furnace 50. The method comprises the steps of operating the direct current arc furnace 50 with a vessel 48 having an old bottom furnace shell 9*a* to melt metal 44. Next there is the step of terminating the operation of the furnace 50. Then there is the step of separating a furnace cover 8 of the vessel 48 from the old furnace shell 9*a* having a bottom electrode 11. Next there is the step of disconnecting the old furnace shell 9*a* from the furnace 50. Then there is the step of removing the old furnace shell 9*a* from the furnace 50. Next there is the step of placing a new bottom furnace shell 9*b* having a bottom electrode 11 with the furnace 50. Then there is the step of connecting the new furnace shell 9*b* with the furnace 50. Next there is the step of putting the furnace cover 8 on the new furnace shell 9*b*. Then there is the step of operating the furnace 50 with the new furnace shell 9*b* to melt metal 44.

Preferably, after the removing step, there is the step of repairing the old furnace shell 9*a*. After the terminating step, there is preferably the step of draining metal 44 from the old furnace shell 9*a*.

Figure 2C:
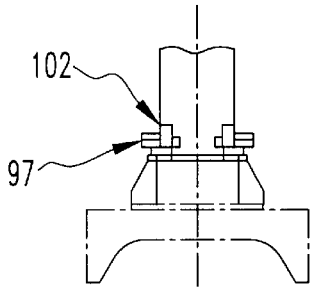
Figure 6A:
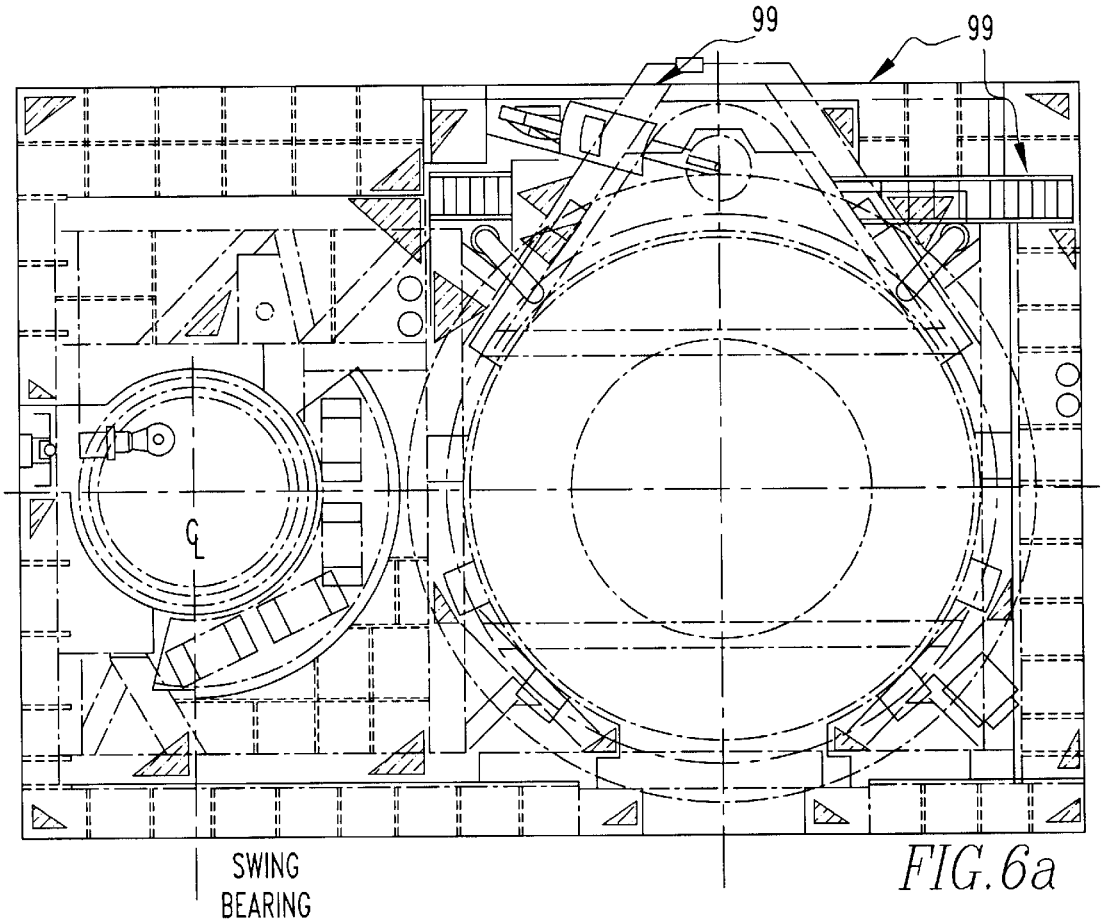
FIGS. 6*a*–6*c* are schematic representations of the furnace with platforms.
Figure 6C:
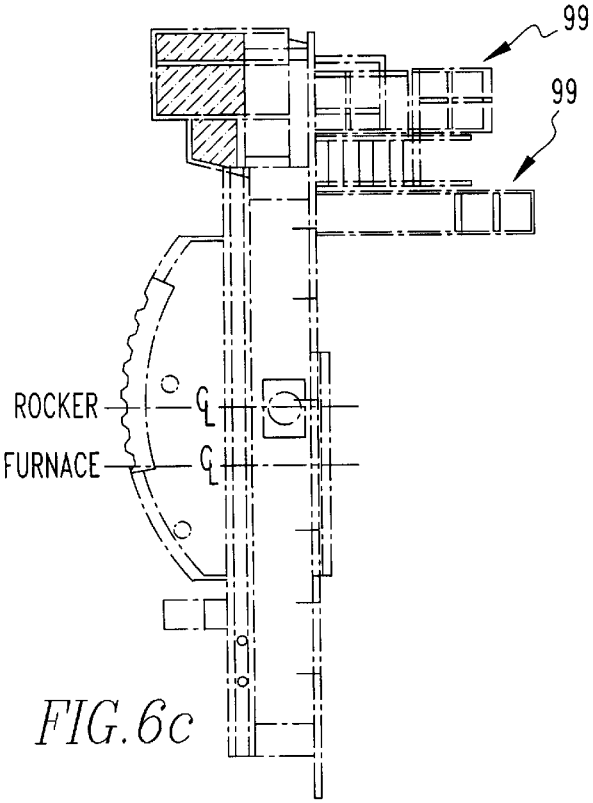
Figure 6B:
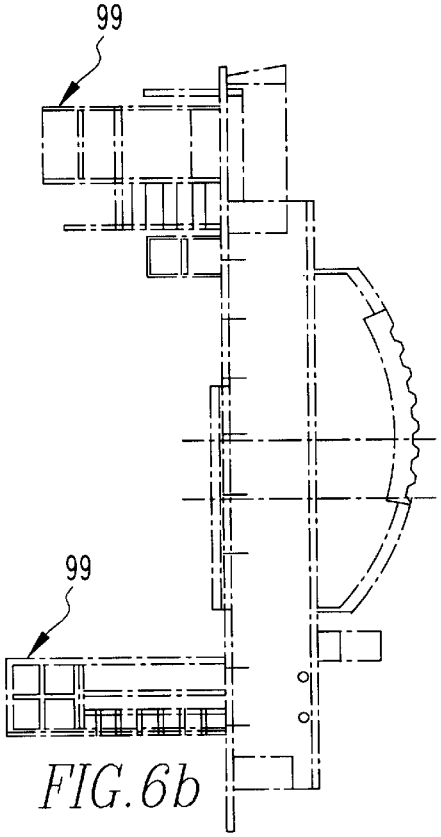
Figure 7:
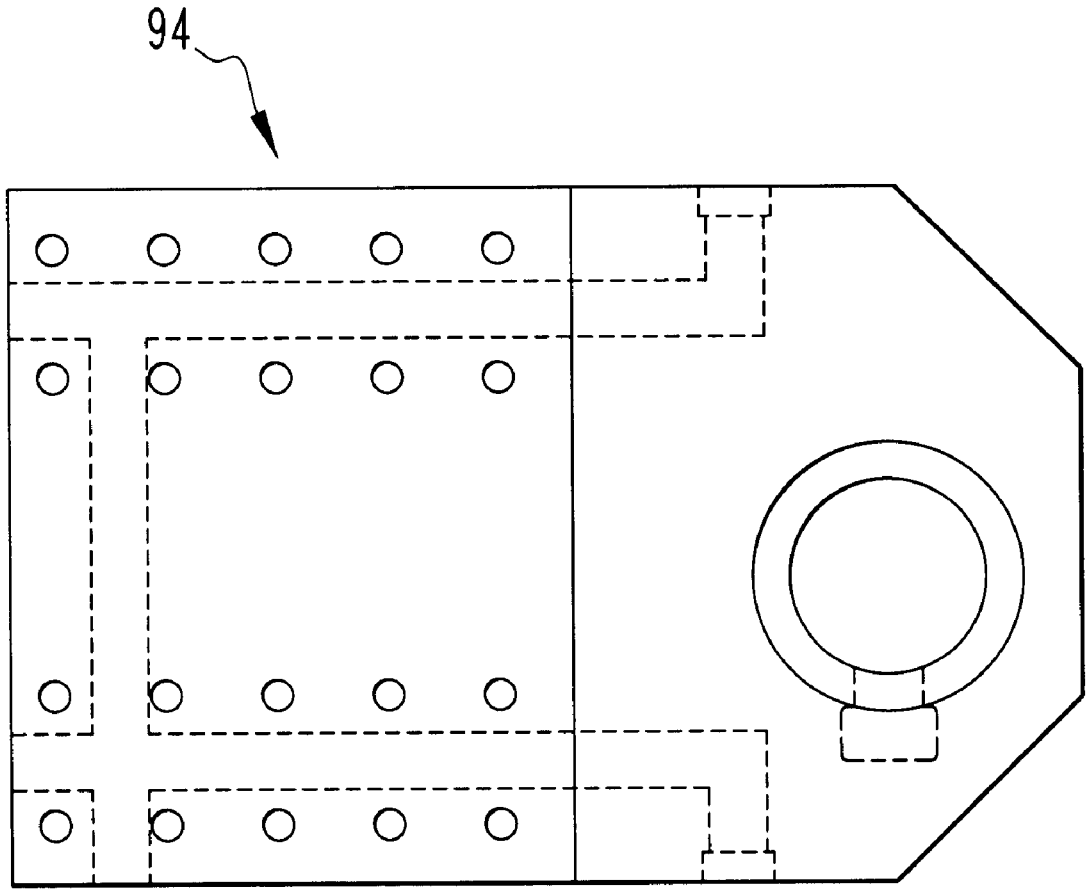
FIG. 7 is a schematic representation of a portion of the turn coil which connects with the power cables.

The disconnecting step preferably includes the step of disconnecting all water, air, gas, oxygen and power connections from the old furnace shell 9*a*. The disconnecting step preferably also includes the step of removing all hold down wedges 97, as shown in FIG. 2*c*, and platforms 99, as shown in FIGS. 6*a*–6*c*, from the old furnace shell 9*a*.

The removing step preferably includes the steps of lifting the old furnace shell 9*a* with a first crane 89*a* off from tilt platform 10 of the furnace 50, as shown in FIG. 1*a* and FIG. 9. Then there is the step of moving the first crane 89*a* with the old furnace shell 9*a* to a repair area 80. Next, there is the step of depositing the old furnace shell 90 at the repair area 80.

The placing step preferably includes the steps of lifting the new furnace shell 9*b* with a crane 89. Next there is the step of moving the new furnace shell 9*b* with the crane 89 to the furnace 50. Then there is the step of placing the new furnace shell 9*b* on the tilt platform 10 of the furnace 50.

The connecting step preferably includes the step of reconnecting all water, air, gas, oxygen and power connections with the new furnace shell 9*b*. Preferably, after the reconnecting step, there is the step of re-installing all hold down wedges 97 and platforms 99 with the new furnace shell 9*b*.

The repairing step preferably includes the step of separating the bottom electrode 11 of the old furnace shell 9*a* from the old furnace shell 9*a*. Preferably, after the separating the bottom electrode 11 step, there is the step of mounting another bottom electrode 11*b* to the old furnace shell 9*a* to fix the old furnace shell 9*a*.

Figure 1B:
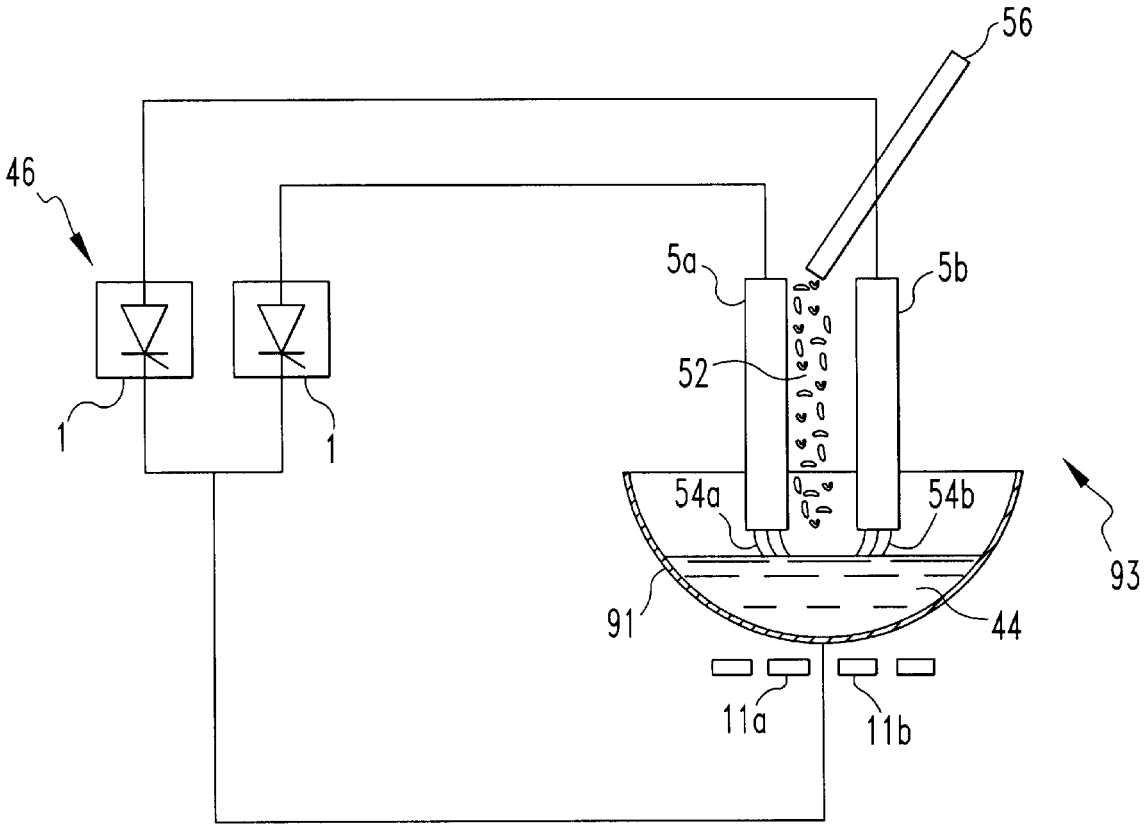
FIG. 1*b* is a schematic representation of a side view of a portion of the furnace.

In the operation of the preferred embodiment and referring to FIGS. 1*a* and 1*b*, the DC arc furnace 50 comprises a refractory lined furnace shell 9 to contain the material to be melted, a furnace cover 8 to contain the heat energy in the furnace shell, one or more top electrodes 5, typically of graphite, protruding through the furnace cover 8 and capable of moving vertically in order to establish and arc between the tip of the electrode and the material 44 to be melted, an electrode arm 4 for each top electrode to support the electrode, a movable mast 20 to raise and lower the electrode, one or more bottom electrodes 11 located in the bottom of the furnace shell 9, one or more DC power supplies 1 to provide the necessary electrical energy to the furnace for melting, the necessary anode and cathode water cooled cables 2 and 3 to conduct the electrical energy from the power supplies to the furnace, typically the anode connections 3 go to the bottom electrode 11 and the cathode connections 2 to the top electrode 5. There is a tilt platform 10 which supports the furnace vessel 48, the superstructure 59, the electrode arms 4*a* and 4*b* and the electrodes 5*a* and 5*b* and provides for the capability to tilt the furnaces for tapping purposes and slagging off purposes.

A typical operation sequence consists of removing the furnace cover 8 from the furnace shell 9 of the vessel 48, placing the charge material 44 (typically scrap iron and/or steel) in the furnace shell 9, putting the furnace cover 8 back on the furnace shell 9, energizing the DC furnace power supply 1 (which include, for instance, rectifiers of the power supply mechanism 46), and lowering the top electrode 5 to establish an arc 54, as shown in figure 1*b*, between the charge material which is electrically in contact with the bottom electrode 11 and the tip of the top electrode 5. This arcing continues until the charge material is melted. At this time, if additional molten material 44 is required, the above sequence will be repeated one or more times, or it might be desirable to continuously feed unmelted iron substitutes such as pre-reduced iron pellets into the molten charge material at a rate which corresponds to the capability of the furnace to melt it. This will continue until such time that the required total amount of molten material in the furnace is reached. At that point in time, the furnace is tapped (the molten material is poured into another vessel 69) for further processing.

By using an off-furnace bottom electrode exchange, the furnace downtime for an off-line bottom electrode exchange can be limited to 4–8 hours depending on the amount of auxiliary equipment such as burners which must be disconnected and re-connected. The basic off-line bottom electrode exchange procedure is outlined below.

1) The vessel 48 of the furnace 50 is drained of metal
2) All water, air, gas, oxygen and power connections are disconnected from the old furnace shell 9*a*.
3) Any hold down wedges 97, as shown in FIG. 2*c*, and removable platforms 99, as shown in FIG. 6, are removed.
4) The old furnace shell 9*a* is removed from the tilt platform by crane and taken to the push-up area 81 of the repair area 80.
5) A complete new furnace shell 9*b* which has been repaired off-line is picked up from the furnace repair area 80 with the crane and set in the tilt platform 91.
6) All water, air, gas, oxygen and power connections are re-connected on the furnace shell.
7) All hold down wedges 97 and platforms 99 are re-installed.
8) The furnace 50 is re-started.
9) The bottom electrode 11 of the old furnace shell 9*a* is pushed out off-line.
10) The old furnace shell 9*a* is lifted by crane 89, either the same crane 89 which is used to move the new furnace shell 9*b* or a different crane, from the push-up area 81 to another location for repair or repairs may be made at the repair area 80 with the push-up area 81.
11) The new or repaired bottom electrode is placed in the vessel and all other necessary repairs are performed so that the shell is ready for the next exchange.

In order to minimize the shell exchange time several design changes were made to existing furnaces.

Figure 4:
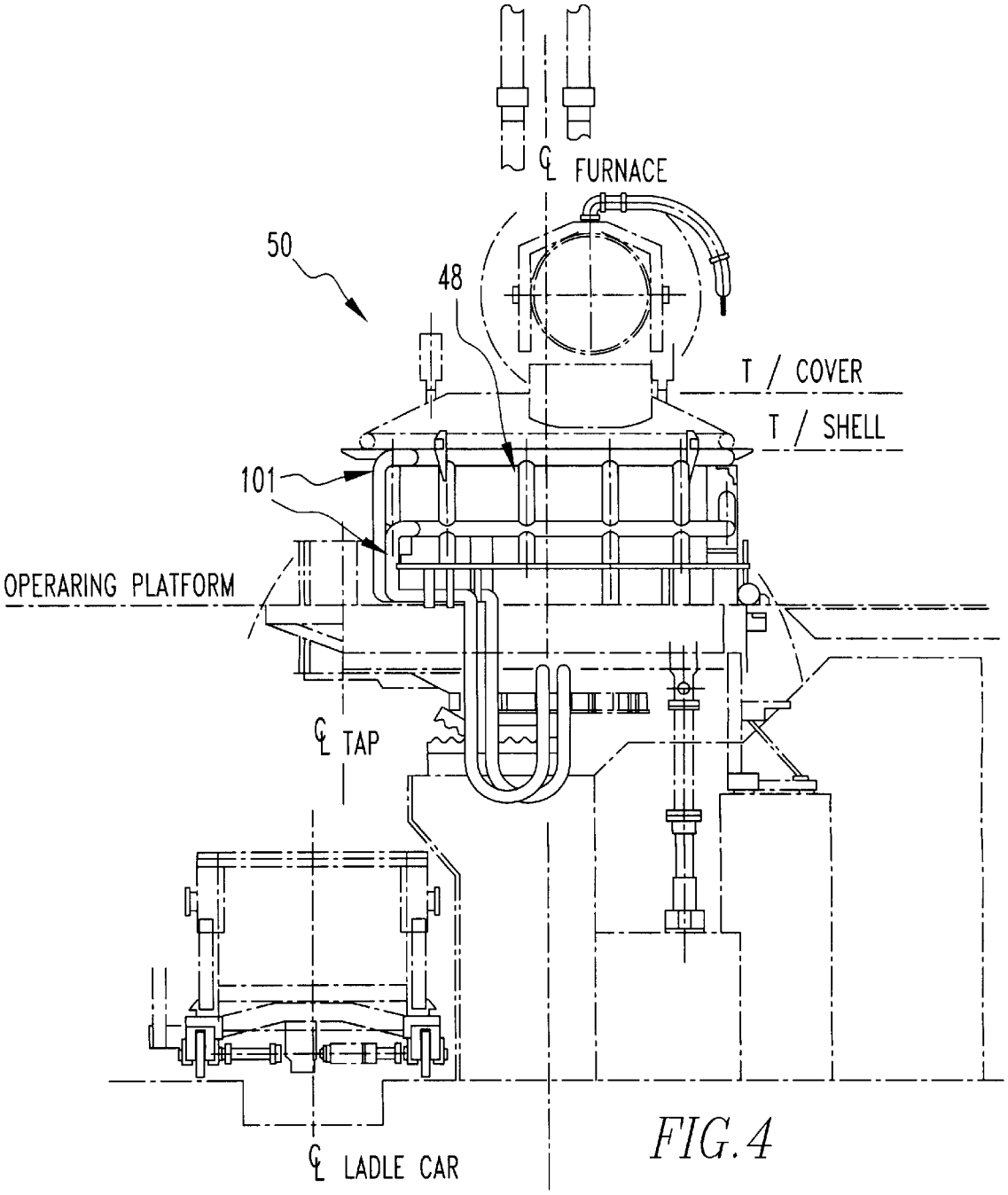
FIG. 4 is a schematic representation of a side view of the furnace.
Figure 5C:
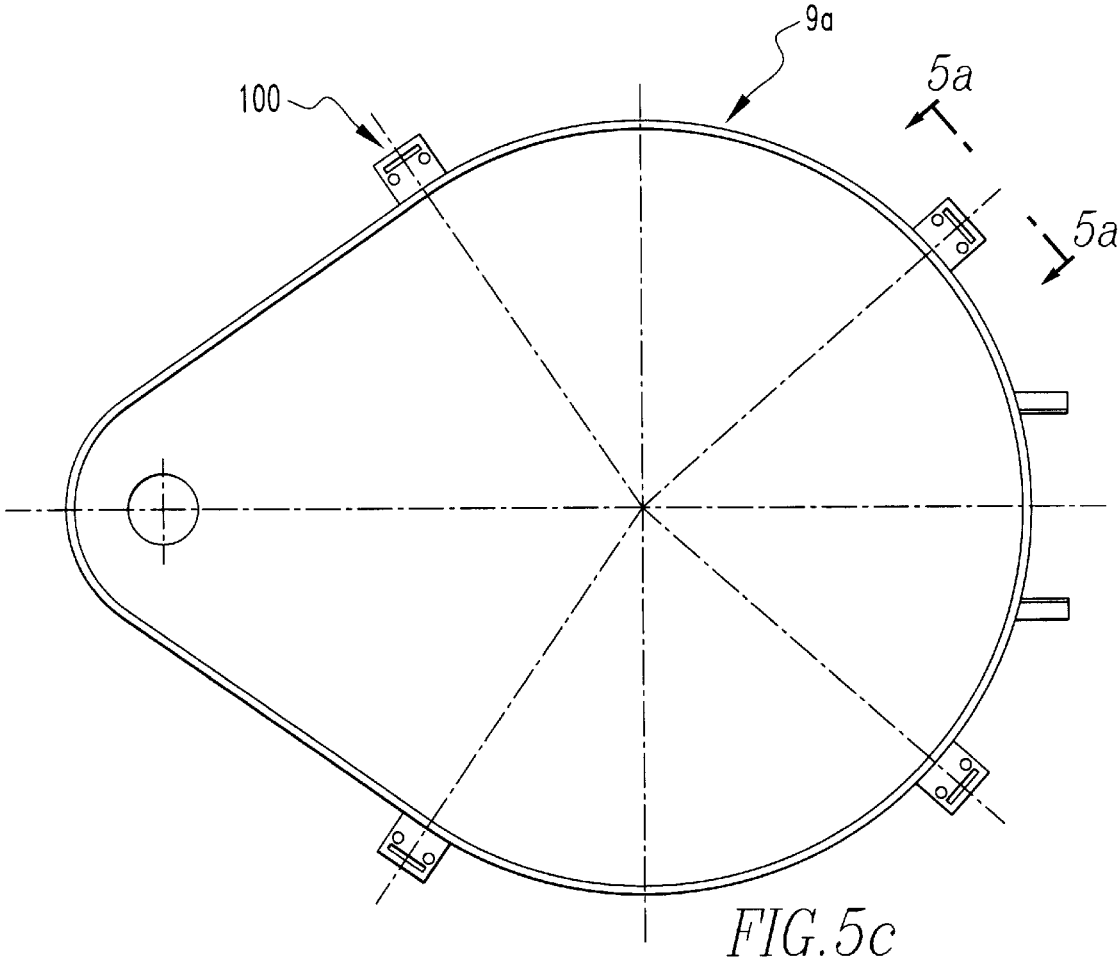
FIGS. 5*a* and 5*b* are schematic representations of a shell of the furnace.
Figure 5A:
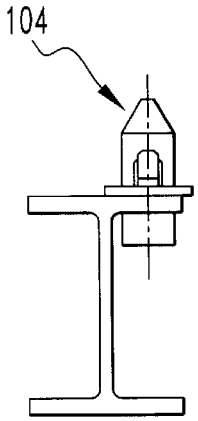
Figure 5B:
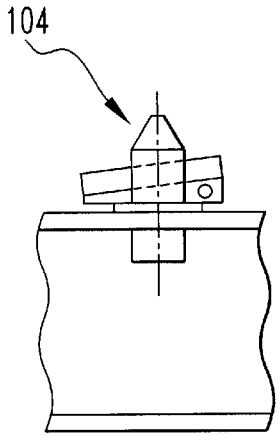

1) Items previously supported off of the shell such as the turncoil and heat shields were changed to be supported off of the tilt platform 10.
2) Flexible hoses for the main supply and return water connections, as shown in FIG. 4, were added so that slight differences between furnace shells and furnace position on the tilt platform 10 could be accommodated.
3) Flexible water cooled power cables 101 between the turncoil and the bottom electrode 11, as shown in FIG. 4, were added to compensate for any differences between bottom electrode placement in a furnace shell or alignment of the shell in the tilt platform 10.
4) Water, air, gas and oxygen connections for auxiliary equipment such as burners were designed with quick disconnects and/or unions which are well known in the art to facilitate faster exchanges.
5) Work platforms around the furnace were designed with hold down pins 102 and wedges 97, as shown in FIG. 2*c*, which are well known in the art, so the can be lifted off of the tilt platform 10 to give better access to the shell.
6) The shell 9*a* was designed with alignment holes 100 that fit over pins 104 welded to the tilt platform, as shown in FIGS. 5*a* and 5*b*. These pins guide the shell into the proper position on the tilt platform. These same holes line the furnace up with pins at the push-up station and repair station. The furnace shell is secured by wedges at the push-up station so the push-up device does not pick up the entire furnace shell.
7) The shell was designed with lifting lugs so that it can be easily transported by crane.
8) The push-up head of the push-up device has a removable guide beam 92 for aligning the terminal blades 94 on the bottom electrode so that they will be in the proper position to connect to the power cables on the tilt platform 10. This guide beam 92 is removed for pushing out the bottom electrode.

The bottom electrode has a terminal with one or more steel or copper blades. These blades have bolt holes for attaching the turncoil to the bottom electrode. On prior art bottom electrodes, the turncoil had a copper blade with bolt holes to match up to the blades of the bottom electrode terminal. These blades are machined and silver plated to provide a uniform contact surface. The blades typically have 10 or more bolts to achieve and maintain the necessary contact force between the blades. Alignment of these blades is very critical for getting all of the bolts in and tightened to the proper torque. If the blade connection is not tightened correctly, small gaps between the surface of the blades can lead to localized arcing and overheating of the blades.

Alignment of the blades on the bottom electrode with the blades on the turncoil is very difficult due to the large mass of the bottom electrode 11. When it is suspended from the crane sling, it tends to swing and rotate some as it is lowered into the furnace shall. It takes several men guiding the bottom electrode from above along with someone watching the alignment of the blades from below to attain the proper alignment. This alignment problem can be mitigated by using flexible water cooled power cables for the connection between the bottom electrode terminal and the turncoil. The water cooled power cables can accommodate approximately a ½" to 1" misalignment in any axis. The water cooled power cable is constructed of an internal rubber hose which carries the water around which the copper wire stranded cable is wrapped. The power cable has an exterior cover for insulation. Each end of the power cable has a water cooled copper blade with bolt holes.

Since the furnace shell with the bottom electrode is being removed from the tilt platform where the turncoil is located a means to align the bottom electrode at the push-up area is necessary. The push-up head on the bottom electrode push-up device was designed with a slot to accept an alignment flange. This alignment flange is a wide flange beam that sits on top of the push-up head in the slots provided and replicates the location and orientation of the blades of the water cooled power cables attached to the turncoil on the tilt platform. The alignment flange has plywood on the sides to protect the silver plated surfaces on the bottom electrode terminal blades. As the new or repaired bottom electrode is lowered into the furnace shell, the blades of the bottom electrode are guided to fit around the alignment flange which ensures that the bottom electrode terminal blades will be properly oriented when the furnace shall is exchanged back into the tilt platform, as shown in FIG. 8.

The alignment flange has a lifting lug on the top side so it may be removed from the slot in the push-up head by crane and stored. This removal is necessary so that the alignment beam does not interfere with the bottom electrode terminal when the bottom electrode is pushed up out of the furnace shell.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for operating a direct current arc furnace comprising the steps of:

operating the direct current arc furnace with an old vessel to melt metal;

terminating the operation of the furnace;

disconnecting the old vessel of the furnace from the furnace;

removing the old vessel having a bottom electrode from the furnace;

placing a new vessel having a bottom electrode with the furnace;

connecting the new vessel with the furnace;

turn-on the operation of the furnace operating the furnace with the new vessel to melt metal.

2. A method for operating a direct current arc furnace comprising the steps of:

operating the direct current arc furnace with a vessel having an old bottom furnace shell to melt metal;

terminating the operation of the furnace;

separating a furnace cover of the vessel from the old furnace shell having a bottom electrode;

disconnecting the old furnace shell from the furnace;

removing the old furnace shell from the furnace;

placing a new bottom furnace shell having a bottom electrode with the furnace;

connecting the new furnace shell with the furnace;

putting the furnace cover on the new furnace shell;

turn-on the operation of the furnace operating the furnace with the new furnace shell to melt metal.

3. A method as described in claim 2 including after the removing step, there is the step of repairing the old furnace shell.

4. A method as described in claim 3 including after the terminating step, there is the step of draining metal from the old furnace shell.

5. A method as described in claim 4 wherein the disconnecting step includes the step of disconnecting all water, air, gas, oxygen and power connections from the old furnace shell.

6. A method as described in claim 5 wherein the disconnecting step includes the step of removing all hold down wedges and platforms from the old furnace shell.

7. A method as described in claim 6 wherein the removing step includes the steps of lifting the furnace shell with a crane off of a tilt platform of the furnace; moving the crane with the old furnace shell to a push-up area; and depositing the old furnace shell at the push-up area.

8. A method as described in claim 7 wherein the placing step includes the steps of lifting the new furnace shell with a second crane; moving the new furnace shell with the second crane to the furnace; and placing the new furnace shell on the tilt platform of the furnace.

9. A method as described in claim 8 wherein the connecting step includes the step of reconnecting all water, air, gas, oxygen and power connections with the new furnace shell.

10. A method as described in claim 9 including after the reconnecting step, there is the step of re-installing all hold down wedges and platforms with the new furnace shell.

11. A method as described in claim 10 wherein the repairing step includes the step of separating the bottom electrode of the old furnace shell from the old furnace shell.

12. A method as described in claim 11 wherein after the separating the bottom electrode step, there is the step of mounting another bottom electrode to the old furnace shell to fix the old furnace shell.

* * * * *